US008000879B2

(12) United States Patent
Zürcher et al.

(10) Patent No.: US 8,000,879 B2
(45) Date of Patent: Aug. 16, 2011

(54) METHOD FOR OPERATING A TWO-STROKE ENGINE

(75) Inventors: Lukas Zürcher, Stuttgart (DE); Claus Naegele, Stuttgart (DE); Georg Maier, Kernen i. R. (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 373 days.

(21) Appl. No.: 12/397,360

(22) Filed: Mar. 4, 2009

(65) Prior Publication Data

US 2009/0228189 A1 Sep. 10, 2009

(30) Foreign Application Priority Data

Mar. 4, 2008 (DE) ..... 10 2008 012 536

(51) Int. Cl.
*F02D 41/00* (2006.01)
*F02B 25/00* (2006.01)

(52) U.S. Cl. ..... 701/103; 123/65 R

(58) Field of Classification Search ..... 701/103, 701/101, 102; 123/65 R, 73 A, 73 PP, 198 E
See application file for complete search history.

(56) References Cited

U.S. PATENT DOCUMENTS 5,063,886 A * 11/1991 Kanamaru et al. ..... 123/65 VD
5,257,607 A * 11/1993 Gillespie ..... 123/73 C
6,962,132 B2 11/2005 Hoche et al.

* cited by examiner

*Primary Examiner* — Hieu T Vo
(74) *Attorney, Agent, or Firm* — Gudrun E. Huckett

(57) ABSTRACT

A two-stroke engine has a fuel supply device, an intake passage formed partially in the fuel supply device, and an air filter with clean air chamber. The intake passage upstream of the fuel supply device is connected to the clean air chamber. A partition divides the intake passage downstream of the fuel supply device into a supply passage for fuel-free air and a mixture passage for fuel/air mixture. A throttle valve is supported in the intake passage and aligned in at least one operating state with the partition. A pressure differential between the mixture passage and the supply passage is determined, and in a method for operating such a two-stroke engine, fuel is supplied into the intake passage by a fuel supply valve in the operating state substantially only when the pressure in the mixture passage is not greater than the pressure in the supply passage.

18 Claims, 2 Drawing Sheets

METHOD FOR OPERATING A TWO-STROKE ENGINE

BACKGROUND OF THE INVENTION

The invention relates to a two-stroke engine and a method for operating such a two-stroke engine, wherein the two-stroke engine comprises a fuel supply device in which a section of an intake passage is formed, wherein the intake passage upstream of the fuel supply device is connected to a clean air chamber of an air filter and wherein the intake passage downstream of the fuel supply device is divided by a partition into a supply passage for supplying substantially fuel-free air and a mixture passage for supplying a fuel/air mixture. In the section of the intake passage a throttle valve is pivotably supported and is aligned in at least one operating state with the partition.

U.S. Pat. No. 6,962,132 B1 discloses a two-stroke engine whose intake passage is divided into a mixture passage and an air passage. In order to prevent that fuel from the mixture passage is sucked into the air passage, the clean air chamber of the air filter is completely divided into two chambers.

It has been found that fuel from the mixture passage can pass into the air passage as a result of leaks in the area of the throttle valve. This is undesirable because this causes the exhaust gas values of the two-stroke engine to deteriorate.

SUMMARY OF THE INVENTION

It is an object of the present invention to provide a method for operating a two-stroke engine with which method excellent exhaust gas values are achievable in a simple way. A further object of the invention resides in that a two-stroke engine is to be provided that exhibits excellent exhaust gas values.

In accordance with the present invention, this is achieved in connection with the method in that a valve for the supply of fuel (fuel supply valve) is provided and in that by means of the valve in said at least one operating state fuel is supplied into the intake passage substantially only at those points in time when the pressure in the mixture passage is not greater than the pressure in the supply passage.

In accordance with the present invention this is achieved in connection with the two-stroke engine in that a valve for supplying fuel (fuel supply valve) is provided and in that the two-stroke engine comprises a device that determines the pressure differential between the pressure in the mixture passage and the pressure in the supply passage.

By supplying fuel into the intake passage in the operating state in which the throttle valve is aligned substantially with the partition substantially only at the time when the pressure in the mixture passage is smaller or identical to the pressure in the supply passage, it can be prevented that fuel is sucked into the supply passage as a result of pressure differentials. Accordingly, in a simple way contamination of the supply passage with fuel is prevented. A complex sealing action in the area of the throttle valve is no longer needed. As a result of short required switching times it can be provided that minimal quantities of fuel are supplied at times when the pressure in the supply passage is smaller than the pressure in the mixture passage. A substantial fuel quantity, expediently a minimum of 60%, in particular a minimum of 80%, and advantageously the entire fuel quantity, is however supplied when the pressure in the mixture passage is not higher than the pressure in the supply passage.

The air that is being supplied through the supply passage and that is substantially free of any fuel is utilized as scavenging air and is stored in the transfer passages of the two-stroke engine. The stored scavenging air can escape partially through the outlet upon downward stroke of the piston. Since as a result of controlling the timing when fuel is being supplied only very small quantities of fuel or no fuel at all are contained in the scavenging air, excellent exhaust gas values result. The pressure in the intake passage and in the supply passage is phase-shifted as a result of the different control times of the passages; the pressure in the mixture passage usually reaches lower values than the pressure in the supply passage. In particular during the upward stroke of the piston the pressure in the mixture passage is below the pressure in the supply passage over a period of time that depends on the construction of the two-stroke engine. When supplying fuel during this time period, the fuel is sucked into the mixture passage. As a result of the higher pressure in the supply passage no significant flow from the mixture passage into the supply passage takes place. Usually, a flow will be generated in the opposite direction from the supply passage into the mixture passage when leaks at the partition or in the area of the throttle valve are present. In this way, a transfer of fuel into the supply passage can be prevented in a simple way.

Advantageously, the fuel is sucked into the intake passage as a result of the underpressure in the intake passage. The valve can thus be open also at times when the pressure in the mixture passage is greater than the pressure in the air passage provided that at this point in time the pressure in the mixture passage is also greater than the pressure in the fuel system. As a result of the higher pressure in the intake passage fuel cannot be sucked into the intake passage. In case of a fuel supply valve that is open when currentless it is possible to save energy in this way. The valve must be actively closed only when the pressure in the intake passage is smaller than the pressure in the fuel system and, at the same time, the pressure in the supply passage is smaller than the pressure in the mixture passage.

In order to prevent that fuel flows through the clean air chamber of the air filter into the supply passage, it is provided that at least in said operating state fuel is supplied into the intake passage only at points in time when the pressure in the mixture passage is not higher than the pressure in the clean air chamber of the air filter. Since in the mixture passage underpressure is present relative to the clean air chamber of the air filter, the reverse flow of fuel into the clean air chamber of the air filter is prevented. The fuel is sucked in from the fuel supply device through the mixture passage into the two-stroke engine, usually into the crankcase of the two-stroke engine. A complex division and sealing action of the clean air chamber of the air filter is not required. At the same time, contamination of the air filter by fuel that passes from the mixture passage into the clean air chamber of the air filter is substantially prevented.

The operating state in which the throttle valve is aligned approximately with the partition is advantageously full load operation. In full load operation the intake passage is substantially separated into the mixture passage and the supply passage as a result of the position of the throttle valve. In this way, in full load operation in which the two-stroke engine is usually operated minimal exhaust gas values are achieved. In other operating states such as idling or partial load a minimal supply of fuel through the supply passage can be advantageous in order to provide an excellent running behavior of the two-stroke engine. However, it can also be provided that in any operating state fuel is supplied into the mixture passage substantially only at the point in time when the pressure in the mixture passage is not higher than the pressure in the supply passage and not higher than the pressure in the clean air chamber of the air filter. In this way, the exhaust gas values of the two-stroke engine can be further improved.

It can be provided that only a partial fuel quantity is supplied through the fuel supply valve and that a further, advantageously a smaller, fuel quantity is supplied independent of the switching position of the valve. This can be achieved for example by a fuel passage with a fixed throttle that, in any operating state independent of the switching state of the valve, ensures a minimal supply of fuel. In order to obtain minimal exhaust gas values, it is provided that the entire fuel quantity supplied into the intake passage is supplied through the valve. In this way, it can be substantially prevented that fuel can pass into the supply passage. In this connection, it is particularly provided that the fuel is sucked into the intake passage by means of underpressure (vacuum) that is generated in operation within the intake passage. The valve therefore must only be actively closed when the pressure in the intake passage is lower than the pressure in the fuel system and the pressure in the supply passage is lower than the pressure in the mixture passage.

In a two-stroke engine that has a fuel supply device in which a section of an intake passage is formed, wherein the intake passage is connected upstream of the fuel supply device to the clean air chamber of the air filter, wherein the intake passage downstream of the fuel supply device is divided by a partition into a supply passage for supply of substantially fuel-free air and a mixture passage for supply of fuel/air mixture, and wherein a throttle valve is pivotably supported in the section of the intake passage and is aligned in at least one operating state with the partition, a valve is provided for supply of fuel. The two-stroke engine has an arrangement for detecting the pressure differential between the pressure in the mixture passage and the pressure in the supply passage.

By means of detecting the pressure differential it can be evaluated at which points in time of an engine cycle the pressure in the mixture passage is lower than the pressure in the supply passage or at which points in time these pressures match one another. When the pressure in the mixture passage is higher than the pressure in the supply passage no fuel is supplied. As long as the pressure in the mixture passage is lower than the pressure in the supply passage or matches it, fuel can be supplied to the mixture passage. As a result of the reduced pressure in the mixture passage or the same pressure in both passages, the fuel is sucked into the mixture passage and, as a result of pressure differentials, does not reach the supply passage due to leaks in the passage separation or due to areas of the intake passage that are not separated.

Advantageously, the two-stroke engine comprises a device for detecting the pressure differential between the pressure in the mixture passage and the pressure in the clean air chamber of the air filter. In this way, fuel can be supplied only at points in time of an engine cycle at which time the pressure in the mixture passage is smaller or the same as the pressure in the clean air chamber of the air filter. Taking in mixture into the clean air chamber of the air filter as a result of underpressure in the clean air chamber of the air filter can be prevented in this way.

Advantageously, for detection of the pressure differential between mixture passage and supply passage a device for detecting the pressure in the mixture passage and a device for detecting the pressure in the supply passage are provided that are both connected to a control unit. In the control unit the pressure differential between the two measured pressure values is determined. In this connection, absolute pressure values can be measured but advantageously the relative pressure to the surroundings is utilized for detecting or measuring the pressure. For detecting the pressure differential between the clean air chamber of the air filter and the mixture passage, a device for detecting the pressure in the clean air chamber of the air filter is provided advantageously and connected to the control unit.

It is provided that the fuel supply device has at least one fuel passage opening into the intake passage; this fuel passage is controlled by the fuel supply valve. Advantageously, all fuel passages that open into the intake passage are controlled by the fuel supply valve. In this way, it is achieved that points in time at which in the mixture passage an overpressure relative to the supply passage and/or the clean air chamber of the air filter is present no fuel will be supplied into the intake passage. However, it can also be advantageous to supply a minimal fuel quantity independent of the pressure conditions by means of a separate fuel passage that is not controlled by the valve. Emergency running properties can be ensured by means of such a separate fuel passage. A simple configuration results than the valve is an electromagnetic (solenoid) valve. A solenoid valve enables the required very short valve timing of the valve. Two-stroke engines, in particular two-stroke engines in hand-guided power tools, can be operated at engine speeds between 10,000 and approximately 14,000 r.p.m. Even higher r.p.m. can be provided. Since the valve may be open only for a portion of an engine cycle, very short switching times for the valve result that can be realized however by means of a solenoid valve.

The fuel supply valve is advantageously open when in the currentless state. In this way, the valve must be actuated, i.e., closed, for taking in fuel as a result of the underpressure in the intake passage only when the pressure in the intake passage is smaller than the pressure in the fuel system and when the pressure in the supply passage is lower than the pressure in the mixture passage. In this way, a reduced energy consumption is achieved. As a result of the short switching times it can be provided that the valve is still open or has already been opened when the pressure in the supply passage is lower than the pressure in the mixture passage. In this way, minimal fuel quantities can be supplied even when the pressure in the supply passage is smaller than the pressure in the mixture passage. This can be provided advantageously in case that more precise valve timing of the valve can be realized only with unreasonably high expenditure. A substantial quantity of fuel, expediently at least 60%, advantageously at least 80%, and in particular more than 90% of the supplied fuel quantity, is however supplied when the pressure in the mixture passage is not higher than the pressure in the supply passage.

Advantageously, upstream of the throttle valve a choke is arranged in the intake passage. The choke in normal operation is aligned with the partition and causes a further separation of the intake passage into mixture passage and supply passage so that a direct transfer of fuel into the supply passage is prevented also by the choke. In order to provide a further separation of the passages, it can be provided that between the throttle valve and the choke a section of the partition is arranged. In this way, a separation of mixture passage and supply passage can be achieved as much as possible. Only by leaks in the area between the partition and the throttle valve or the choke is it possible for fuel to pass from the mixture passage into supply passage. This transfer can be prevented by the proposed phase-controlled fuel supply as a function of the pressure conditions.

Advantageously, the clean air chamber of the air filter has a chamber with which the supply passage as well as the mixture passage are connected. A separation of mixture passage and supply passage in the clean air chamber of the air filter is not required.

A simple configuration results when the fuel supply device is a carburetor in which the fuel is sucked in as a result of underpressure generated in operation within the intake passage. For generating the required underpressure, the carburetor has advantageously at least in the circumferential area of the intake passage upstream of the mixture passage a venturi section. The venturi section can also be arranged in the area of the supply passage. However, it can also be provided that the venturi section is recessed in the area of the supply passage It is provided that the two-stroke engine has at least one transfer passage in which in operation substantially fuel-free air from the supply passage is deposited. The two-stroke engine is thus operated with scavenging air.

DESCRIPTION OF THE PREFERRED EMBODIMENTS

Figure 1:
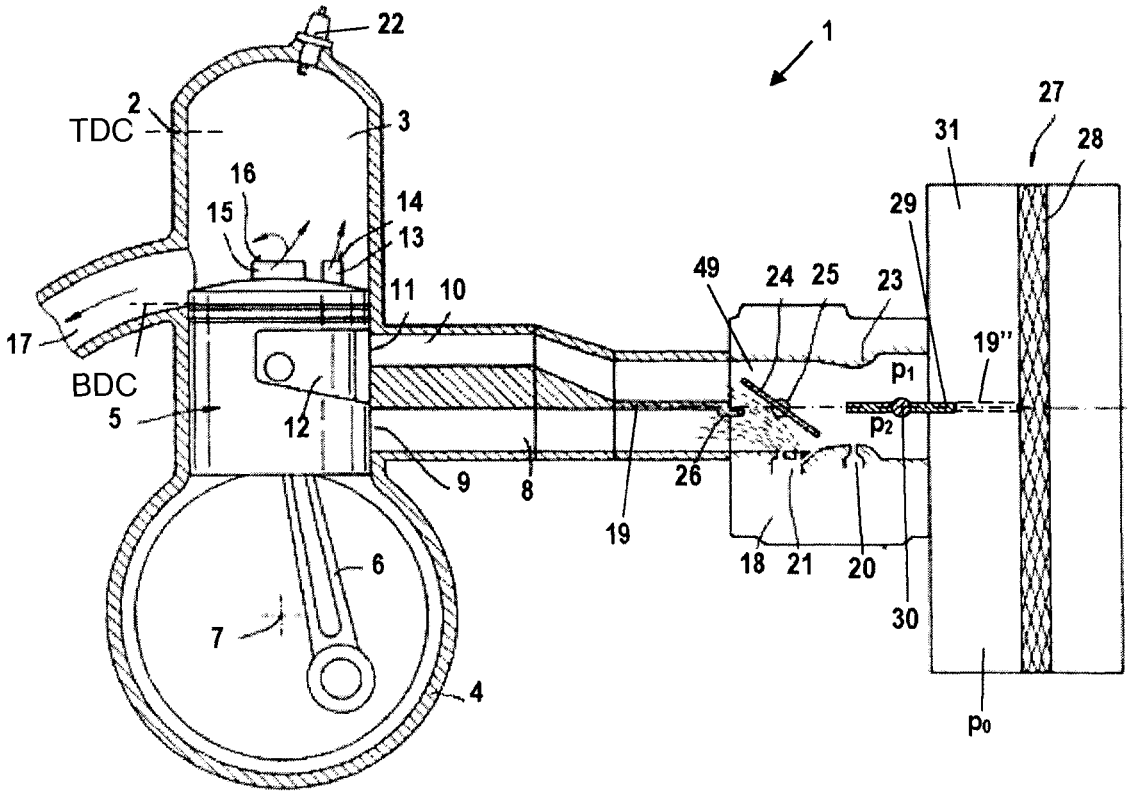
FIG. 1 is a schematic section view of a two-stroke engine.

The two-stroke engine 1 schematically illustrated in FIG. 1 is a single cylinder two-stroke engine that is advantageously used for operating a tool of a hand-guided power tool such as a motor chainsaw, a cut-off machine, a trimmer or the like. The two-stroke engine 1 has a cylinder 2 in which a combustion chamber 3 is formed. The combustion chamber 3 is delimited by piston 5. The piston 5 is supported so as to reciprocate in the cylinder 2 and drives by means of connecting rod 6 a crankshaft 7 rotatably supported in the crankcase 4. The crankcase 4 is connected in the area of bottom dead center BDC of the piston 5 by a total of four transfer passages 13, 15 with the combustion chamber 3. The transfer passages 13 and 15 are arranged symmetrically relative to the section plane indicated in FIG. 1. Two transfer passages 15 are arranged so as to face the outlet 17 of the combustion chamber 3 and two transfer passages 13 face away from the outlet 17. The transfer passages 13 open with transfer ports 14 into the combustion chamber 3 and the transfer passages 15 open with transfer ports 16 into the combustion chamber 3.

For supplying fuel, the two-stroke engine 1 has a fuel supply device that is provided as a carburetor 18. In the carburetor 18 a section of an intake passage 49 is provided in which a throttle valve 24 is pivotably supported on throttle shaft 25. Upstream of the throttle valve 24 a choke 29 is pivotably supported in the intake passage 49 by means of choke shaft 30. Upstream of the carburetor 18 the intake passage 49 opens into a clean air chamber 31 of air filter 27. The clean air chamber 31 is separated by filter material 28 from the surroundings. In the carburetor 18 a venturi section 23 is formed and a main fuel supply opening 20 opens in the venturi section area into the intake passage 49. Downstream of the main fuel supply opening 20 there are auxiliary fuel supply openings 21 that open into the intake passage 49. The auxiliary fuel supply openings 21 and the main fuel supply opening 20 open at a common side of the throttle valve 24 and the choke 29 into the intake passage 49.

Figure 3:
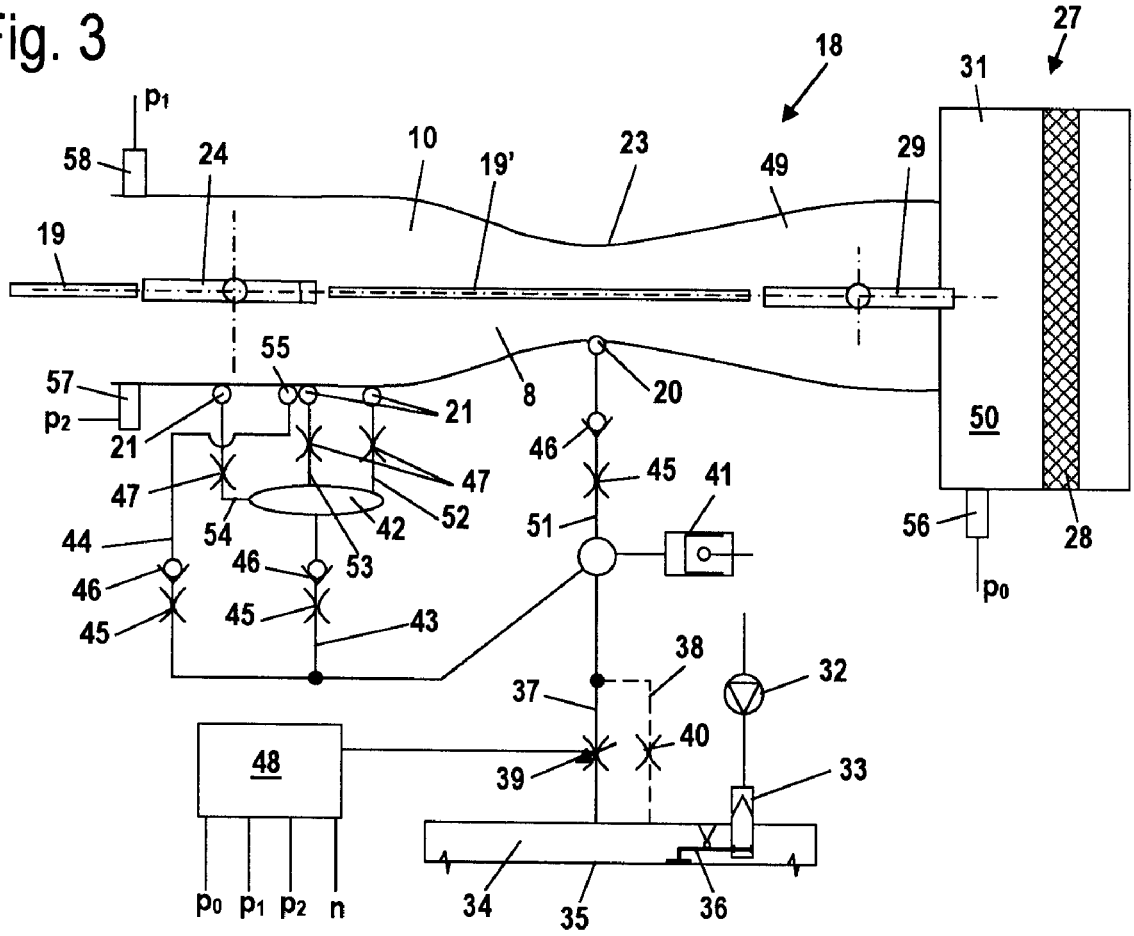
FIG. 3 is a schematic illustration of the carburetor of the two-stroke engine of FIG. 1.

In FIG. 1 it is shown that the intake passage 49 downstream of the carburetor 18 is separated by a partition 19 into a mixture passage 8 and a supply passage 10. The main fuel supply opening 20 and the auxiliary fuel supply openings 21 open into an area of the intake passage 49 that is upstream of the mixture passage 8. A projection 26 is provided on the partition 19 on which the throttle valve 24 rests in the completely open position. In this position the throttle valve 24 is aligned with the partition 19 and in a common plane with the partition 19. The throttle valve 24 effects in its completely open position, corresponding to the full load position, a further separation between mixture passage 8 and supply passage 10. The choke 29 is positioned in completely open position, i.e., when the choke is not actuated, also in alignment with the partition 19 and in a common plane with the throttle valve 24 in its full load position. The full load position of the throttle valve 24 is illustrated in FIG. 3.

As shown in FIG. 1, the mixture passage 8 with mixture inlet 9 opens in an area of the cylinder 2 which area is controlled by the piston 5. In the area of top dead center TDC of the piston 5 the mixture passage 8 is connected by means of mixture inlet 9 to the crankcase 4. The supply passage 10 opens with supply inlet 11 at the cylinder 2. In the area of top dead center TDC of the piston 5 the supply inlet 11 is connected by means of piston recess 12 formed in the piston 5 to the transfer ports 14 and 16 of the transfer passages 13 and 15. Advantageously, one piston recess 12 each is provided on each side of the cylinder 2 and designed to communicate with the two transfer ports 14, 16.

In operation of the two-stroke engine 1 upon upward stroke of the piston 5 fuel/air mixture is taking in through the mixture passage 8 into the crankcase 4. In the transfer passages 13 and 15 substantially fuel-free air is received from the supply passage 10 through the piston recesses 12. Upon downward stroke of the piston 5 first the mixture inlet 9 and the supply inlet 11 are closed. The fuel/air mixture in the crankcase 4 is compressed. In the area of bottom dead center BDC of the piston 5 the transfer ports 14, 16 are opened toward the combustion chamber 3. In this connection, the stored substantially fuel-free air from the supply passage 10 flows first into the combustion chamber 3 and subsequently fuel/air mixture flows from the crankcase 4 into the combustion chamber 3. Upon upward stroke of the piston 5 the fuel/air mixture in the combustion chamber 3 is compressed and in the area of top dead center TDC is ignited by spark plug 22 projecting into the combustion chamber 3. In this way, the piston 5 is accelerated toward the crankcase 4. Upon downward stroke of the piston 5 first the outlet 17 is opened so that the exhaust gases can escape from the combustion chamber 3. The residual exhaust gases are scavenged through the outlet 17 by the scavenging air that is flowing in through the transfer ports 14, 16.

Since a portion of the scavenging air together with the exhaust gases is scavenged through the outlet 17, the air in the supply passage 10 should contain fuel as little as possible. In the partial load position of the throttle valve 24 illustrated in FIG. 1 fuel can flow through the gap between the throttle shaft 25 and the projection 26 at the partition 19 from the mixture passage 8 into the supply passage 10. In the full load position of the throttle valve 24 shown in FIG. 3, the mixture passage 8 and the supply passage 10 are substantially separated from one another. However, only with great constructive expenditure a complete sealing of the passages relative to one another in the area of the throttle valve 24 can be achieved. Upstream of the throttle valve 24, between the throttle valve 24 and the choke 29, a connection between the mixture passage 8 and the supply passage 10 can exist. In order to prevent that in the completely open position of the throttle valve 24, i.e., in full load position, fuel flows from the mixture passage 8 into the supply passage 10, it is proposed to introduce the fuel precisely matched to the phase when the pressure $p_2$ in the mixture passage 8 is smaller or identical to the pressure $p_1$ in the supply passage 10. In order to prevent passage of fuel from the mixture passage 8 into the supply passage 10 through the clean air chamber 31 of the air filter 27, it is provided also that fuel is supplied into the intake passage 49 only when the pressure $p_0$ in the clean air chamber 31 of the air filter 27 is higher than the pressure $p_2$ in the mixture passage 8 or is identical thereto. In this connection, at least the required fuel quantity, expediently at least 60%, advantageously at least 80%, and especially preferred at least 90%, and even more preferred the entire fuel quantity is supplied at the aforementioned points in time. The supply of less than the entire fuel quantity at the aforementioned points in time can be advantageous in particular when the realization of the required switching times is possible with the required precision only at very high expenditure. In this way, sucking in the fuel from the mixture passage 8 into the supply passage 10 or into the clean air chamber 31 of the air filter 27 is substantially, especially completely, prevented.

Figure 2:
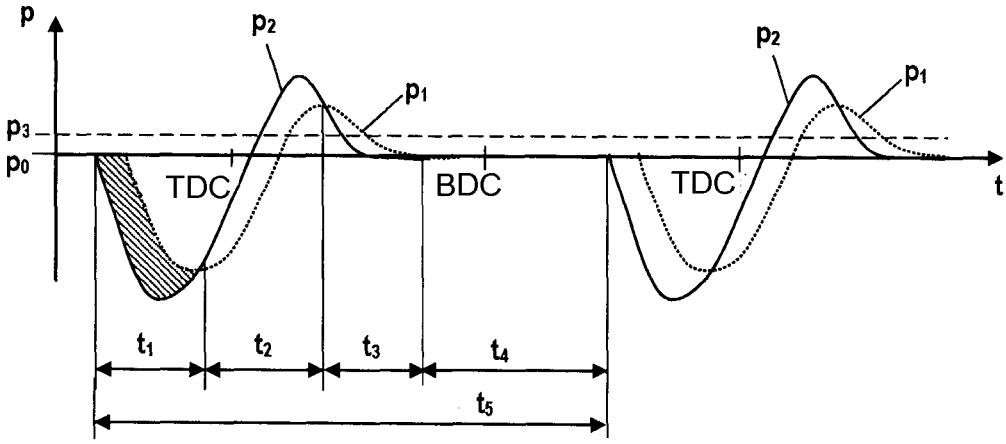
FIG. 2 is a schematic illustration of the pressure curves in the mixture passage and in the supply passage in operation of the two-stroke engine.

FIG. 2 shows schematically the pressure curve of the pressure in the mixture passage 8, in the supply passage 10, and in the clean air chamber 31 of the air filter 27. In this connection, the curve of the pressure p is represented as a function of time t. The pressure $p_0$ in the clean air chamber 31 of the air filter 27 is substantially constant. However, minimal pressure fluctuations in operation may occur. The level of pressure $p_0$ can change over the course of operation as a result of contamination of the filter material 28. The pressure $p_3$ in the fuel system is advantageously somewhat higher than the pressure $p_0$ in the clean air chamber 31 of the air filter 27 and also approximately constant. Upon upward stroke of the piston 5 first the pressure $p_2$ in the mixture passage 8 will drop. With some time delay, the pressure $p_1$ in the supply passage 10 also begins to drop. During this time interval $t_1$ the pressure $p_2$ in the mixture passage 8 is smaller than the pressure $p_1$ in the supply passage 10. During this time interval $t_1$ fuel is being supplied. In this connection, the fuel must not be supplied over the entire time interval $t_1$. This may depend on the fuel quantity to be supplied.

Before reaching top dead center TDC first the pressure $p_2$ in the mixture passage 8 will increase and with time delay also the pressure $p_1$ in the supply passage 10. In the area of top dead center TDC and after top dead center TDC the pressure $p_2$ in the mixture passage 8 is above pressure $p_1$ in the supply passage 10. In the supply passage 10 there is thus underpressure (vacuum) relative to the mixture passage 8. As a result of this underpressure fuel could be sucked in from the mixture passage 8 into the supply passage 10 in case of leaks. During the time span $t_2$ during which the pressure $p_2$ in the mixture passage 8 is above the pressure $p_1$ in the supply passage 10, no fuel should thus be supplied to the mixture passage 8. After top dead center TDC of the piston 5 the pressure $p_2$ in the mixture passage 8 will begin to drop until it matches the pressure $p_0$ in the clean air chamber 31 of the air filter 27. At this point in time, the mixture passage inlet 9 is closed by the piston 5. With time delay, the pressure $p_1$ in the supply passage 10 drops until it reaches the level of pressure $p_0$ in clean air chamber 31 of the air filter 27.

During a third time interval $t_3$, the pressure $p_2$ in the mixture passage 8 is below the pressure $t_1$ in the supply passage 10 but the pressure $p_2$ in the mixture passage 8 is above or at the level of pressure $p_0$ in the clean air chamber 31 of the air filter 27. While the pressure $p_2$ in the mixture passage 8 is above the pressure $p_0$ in the clean air chamber 31, no fuel should be supplied. Advantageously, fuel is still not yet supplied when the pressure $p_2$ matches pressure $p_0$ because in this range only a very small pressure differential to the pressure $p_1$ in the supply passage 10 is present and because, as a result of the same pressure in the mixture passage 8 and in the clean air chamber 31, reverse flow of fuel from the mixture passage 8 into the clean air chamber 31 cannot be completely prevented. In the area of bottom dead center BDC the mixture inlet 9 as well as supply inlet 11 are closed so that in the mixture passage 8 as well as in the supply passage 10 the pressure level of the clean air chamber 31 is present. During the time interval $t_4$ the mixture inlet 9 and supply inlet 11 are closed. During this time interval advantageously no introduction of fuel takes place. The time intervals $t_1$ and $t_4$ together define time interval $t_5$ that corresponds to one revolution of the crankshaft. Supply of fuel is advantageously performed only during the time interval $t_1$ while the pressure $p_2$ in the mixture passage 8 is below the pressure $p_1$ in the supply passage 10 and below the pressure $p_0$ in the clean air chamber 31 of the air filter 27.

As shown in FIG. 1, the partition 19 can also be extended into the clean air chamber 31 of the air filter 27. This is schematically indicated in FIG. 1 by the illustrated partition section 19".

In FIG. 3 the configuration of the carburetor 18 is illustrated in detail. The throttle valve 24 is in full load position, i.e., in completely open position. Downstream of the throttle valve 24 a partition 19 is arranged which extends in the direction of the throttle valve 24. Between the throttle valve 24 and the choke 29, also in completely open position, a partition section 19' is arranged. In this way, the mixture passage 8 and the supply passage 10 are substantially separated from one another. It can be provided that the throttle valve 24 and the choke 29 rest against projections of the partition 19 in order to achieve in this way a separation of passages 8 and 10 as much as possible. In the clean air chamber 31 there is a chamber 50 into which the section of the intake passage 49 connected to the mixture passage 8 as well as the section of the intake passage 49 connected to the supply passage 10 open. In the illustration of FIG. 3 the chamber 50 of the clean air chamber 31 is not separated by a partition section 19" into several chambers.

A pressure sensor 56 is provided that detects the pressure $p_0$ in the chamber 50 of the clean air chamber 31. In the area of the throttle valve 24 or downstream of the throttle valve 24 a pressure sensor 57 is provided that detects the pressure $p_2$ in the mixture passage 8 and a pressure sensor 58 that detects the pressure $p_1$ in the supply passage 10. The pressure sensors 56, 57 and 28 are connected to an electronic control unit (ECU) 48 of the two-stroke engine 1. The control unit 48 is also connected to an engine speed sensor that provides a signal corresponding to the engine speed n of the two-stroke engine 1. It can be, for example, a generator or alternator (not illustrated in the drawing) that is arranged on the crankshaft 7 or a crankshaft sensor. Also, the signal that is generated by the ignition module of the two-stroke engine 1 can be utilized for determining the engine speed n.

The carburetor 18 has a control chamber 34 which is supplied by fuel pump 32. The fuel pump 32 is connected by intake valve 33 to the control chamber 34. The intake valve 33 is controlled by a control diaphragm 35 with which it is connected by means of lever 36. The control diaphragm 3 can be deflected, for example, as a function of the ambient pressure. A fuel passage 37 extends away from the control chamber 34; a solenoid valve 39 is arranged in the passage 37. The solenoid valve 39 as a fuel supply valve is controlled by the control unit 48 as a function of the pressure conditions in the clean air chamber 31, in the mixture passage 8, and in the supply passage 10 and as a result of the pressure $p_3$ in the fuel system. In this connection, the solenoid valve 39 opens when the pressure $p_2$ in the mixture passage 8 is smaller than the pressure $p_1$ in the supply passage 10 and the pressure $p_0$ in the clean air chamber 31. It can also be provided that the solenoid valve 39 opens also when the pressure $p_2$ in the mixture passage 8 matches the pressure $p_1$ in the supply passage 10 and the pressure $p_0$ in the clean air chamber 31. Fuel is sucked into the intake passage 49 when the pressure $p_3$ in the fuel system is greater than the pressure $p_2$ in the mixture passage 8. As shown in FIG. 2, the pressure $p_2$ during time intervals $t_2$ and $t_3$ is partially above the pressure $p_3$ in the fuel system. At these points in time, no fuel can be sucked in as a result of the pressure $p_2$ being too high. At these points in time the valve 39 can be open. This is in particular advantageous when the valve 39 is open when currentless. Since the valve 39 is also open partially during time periods $t_2$ and $t_3$, energy can be saved. Instead of the solenoid valve 39 a valve of a different configuration can also be used as long as the required short switching times can be realized.

As indicated in FIG. 3 by dashed lines, a bypass in the form of bypass passage 38 can be provided to the solenoid valve 39; the bypass ensures a minimum supply of fuel in any operating state. Advantageously, in the bypass passage 38 a fixed throttle 40 is arranged. The bypass passage 38 opens downstream of the valve 39 into the fuel supply passage 37. A line that is connected to an accelerator pump 41 opens into the fuel passage 37. The fuel passage 37 supplies the fuel passage 51 that is connected by means of throttle 45 and check valve 46 with the main fuel supply opening 20. The fuel passage 51 opens through main fuel supply opening 20 in the area of the venturi section 23 into the intake passage 49 on the side of the partition 19' facing the mixture passage 8. An idle passage 43 branches off the fuel passage 37 and is connected by means of throttle 45 and check valve 46 to idle chamber 42. Fuel passages 52, 53 and 54 extend away from idle chamber 42 and are each connected by a throttle 47 to an auxiliary fuel supply opening 21.

The fuel passage 37 is also connected to a partial load passage 44 that opens by means of throttle 45 and check valve 46 at a partial load fuel supply opening 55 into the intake passage 49 upstream of the mixture passage 8.

By means of fuel supply openings 20, 21, 55 fuel is sucked in from the control chamber 34 in operation as a result of the vacuum or underpressure present in the mixture passage 8. The supplied fuel quantity and the point in time or time intervals at which fuel can be sucked in is determined by the control unit 48 by switching the solenoid valve 39. In this way, it is ensured by simple means that no fuel or only a minimal fuel quantity through bypass passage 38 is supplied as long as in the supply passage 10 or in the clean air chamber 31 relative to mixture passage 8 a vacuum or underpressure is present. Accordingly, sucking in fuel from the mixture passage 8 into the supply passage 10 can be prevented in a simple way.

It can be provided that minimal fuel quantities, advantageously less than 40%, in particular less than 20%, of the supplied fuel quantity are supplied even when the pressure $p_2$ in the mixture passage 8 is higher than the pressure $p_1$ in the supply passage 10, for example, as a result of tolerances of the achievable switching times of the valve 39.

The specification incorporates by reference the entire disclosure of German priority document 10 2008 012 536.9 having a filing date of Mar. 4, 2008.

While specific embodiments of the invention have been shown and described in detail to illustrate the inventive principles, it will be understood that the invention may be embodied otherwise without departing from such principles.

What is claimed is:

1. A two-stroke engine comprising:

a fuel supply device;

an intake passage having a section that is formed in the fuel supply device;

an air filter with a clean air chamber, wherein the intake passage upstream of the fuel supply device is connected to the clean air chamber;

a partition arranged in the intake passage downstream of the fuel supply device and dividing the intake passage into a supply passage that supplies substantially fuel-free air and a mixture passage that supplies a fuel/air mixture;

a throttle valve pivotably supported in the section of the intake passage and aligned in at least one operating state with the partition;

a fuel supply valve;

an arrangement for determining a pressure differential between a pressure in the mixture passage and a pressure in the supply passage.

2. The two-stroke engine according to claim 1, wherein the arrangement comprises a device for determining a pressure differential between the pressure in the mixture passage and a pressure in the clean air chamber of the air filter.

3. The two-stroke engine according to claim 1, wherein the arrangement comprises a first device for detecting the pressure in the mixture passage and a second device for detecting the pressure in the supply passage, and further comprises an electronic control unit wherein the first and second devices are connected to the control unit.

4. The two-stroke engine according to claim 3, wherein the arrangement comprises a third device for detecting the pressure in the clean air chamber, wherein the third device is connected to the electronic control unit.

5. The two-stroke engine according to claim 1, wherein the fuel supply device comprises at least one fuel passage that opens into the intake passage, wherein the at least one fuel passage is controlled by the fuel supply valve.

6. The two-stroke engine according to claim 1, wherein the fuel supply device comprises several fuel passages that open into the intake passage, wherein the fuel passages are controlled by the fuel supply valve.

7. The two-stroke engine according to claim 1, wherein the fuel supply valve is a solenoid valve.

8. The two-stroke engine according to claim 1, comprising a choke arranged in the intake passage upstream of the throttle valve.

9. The two-stroke engine according to claim 8, wherein a section of the partition is arranged between the throttle valve and the choke.

10. The two-stroke engine according to claim 1, wherein the clean air chamber of the air filter has a chamber to which the supply passage and the mixture passage are connected.

11. The two-stroke engine according to claim 1, wherein the fuel supply device is a carburetor and wherein fuel is sucked into the carburetor by underpressure generated in the intake passage in operation of the two-stroke engine.

12. The two-stroke engine according to claim 11, wherein the carburetor comprises a venturi section at least in a circumferential area that is upstream of the mixture passage.

13. The two-stroke engine according to claim 1, comprising at least one transfer passage into which in operation substantially fuel-free air supplied through the supply channel is deposited as scavenging air.

14. A method for operating a two-stroke engine, wherein the two-stroke engine comprises a fuel supply device and an intake passage having a section that is formed in the fuel supply device, and further comprises an air filter with a clean air chamber, wherein the intake passage upstream of the fuel supply device is connected to the clean air chamber, wherein the intake passage downstream of the fuel supply device is divided by a partition into a supply passage that supplies substantially fuel-free air and a mixture passage that supplies a fuel/air mixture, wherein a throttle valve is pivotably supported in the section of the intake passage and is aligned in at least one operating state with the partition; the method comprising:

supplying fuel into the intake passage by a fuel supply valve at least in said at least one operating state substantially only at a time when a pressure in the mixture passage is not greater than a pressure in the supply passage.

15. The method according to claim 14, wherein in at least said at least one operating state fuel is supplied into the intake passage only at a time when said pressure in the mixture passage is not greater than a pressure in the clean air chamber of the air filter.

16. The method according to claim 14, wherein said at least one operating state is a full load state of the two-stroke engine.

17. The method according to claim 14, wherein the entire quantity of the fuel supplied into the intake passage is supplied through the fuel supply valve.

18. The method according to claim 14, wherein the fuel is sucked in by underpressure generated in the intake passage in operation of the two-stroke engine.

* * * * *